United States Patent [19]

Malek

[11] 4,159,240

[45] * Jun. 26, 1979

[54] SEPARATING LIQUID AND SOLID PRODUCTS OF LIQUEFACTION OF COAL OR LIKE CARBONACEOUS MATERIALS

[76] Inventor: John M. Malek, P.O. Box 71, Lomita, Calif. 90717

[ * ] Notice: The portion of the term of this patent subsequent to Apr. 18, 1995, has been disclaimed.

[21] Appl. No.: 891,180

[22] Filed: Mar. 29, 1978

Related U.S. Application Data

[63] Continuation-in-part of Ser. No. 648,108, Jan. 12, 1976, Pat. No. 4,085,029.

[51] Int. Cl.[2] ..... C10G 19/02

[52] U.S. Cl. ..... 208/177; 208/8 LE; 208/283; 208/284

[58] Field of Search ..... 208/8, 10, 263, 177, 208/283, 284; 210/56

[56] References Cited

U.S. PATENT DOCUMENTS

| | | | |
|---|---|---|---|
| 1,794,865 | 3/1931 | Pier et al. | 208/8 |
| 1,925,551 | 9/1933 | Wietzel et al. | 208/8 |
| 2,202,901 | 6/1940 | Dreyfus | 208/8 |
| 2,266,359 | 12/1941 | Edwards, Jr. et al. | 208/263 |
| 2,605,212 | 7/1952 | Lobban | 208/263 |
| 2,654,659 | 10/1953 | Gilbert et al. | 208/10 |
| 4,085,029 | 4/1978 | Malek | 208/8 LE |

*Primary Examiner*—George Crasanakis

[57] ABSTRACT

Slurryform products of coal liquefaction are treated with caustic soda in presence of $H_2O$ in an inline static mixer and then the treated product is separated into a solids fraction and liquid fractions, including liquid hydrocarbons, by gravity settling preferably effected in a multiplate settling separator with a plurality of settling spacings.

11 Claims, 1 Drawing Figure

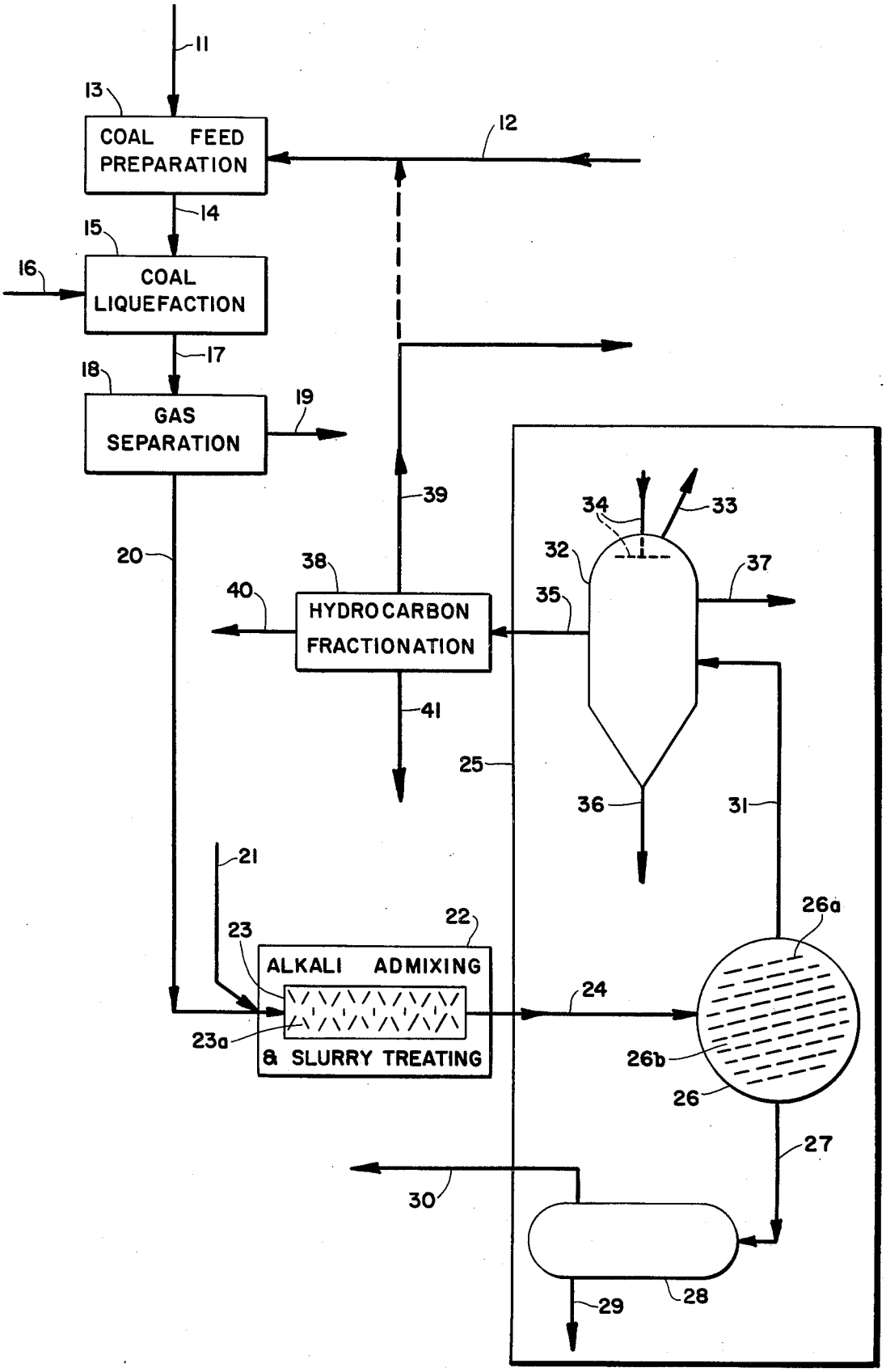
11
13
COAL FEED PREPARATION
12
14
15
16
COAL LIQUEFACTION
17
18
GAS SEPARATION
19
39
34
33
32
37
20
38
40
HYDROCARBON FRACTIONATION
35
41
25
36
31
21
22
26a
23
ALKALI ADMIXING
24
23a
& SLURRY TREATING
26b
26
27
30
28
29

SEPARATING LIQUID AND SOLID PRODUCTS OF LIQUEFACTION OF COAL OR LIKE CARBONACEOUS MATERIALS

CROSS-REFERENCE TO RELATED APPLICATION

This application is a continuation-in-part of application Ser. No. 648,108 filed Jan. 12, 1976, now U.S. Pat. No. 4,085,029.

This invention relates to a method for improving the separability of solids from liquids originating from chemical reactors for converting carbonaceous solids such as coal into useful hydrocarbon liquids, solids, and gasiform products.

It is known that one of major problems in various coal conversion technologies is the difficulty of separating coal derived solid particles from highly viscous liquid solutions originating from the chemical reactor in which the carbonaceous material, usually bituminous coal, sub-bituminous coal or lignite, and preferably bituminous coal, was subjected to liquefying conditions including relatively high temperatures and pressures, and usually the presence of a coal liquefaction solvent which may be any of the variety of coal liquefaction solvents used in the art, including hydrogen donor solvents, non-hydrogen solvents, and mixtures thereof, in presence or absence of added hydrogen, and in presence or absence of catalysts; preferably the coal conversion being effected in presence of a coal liquefaction solvent by hydrogenation of coal in a catalyst bed which may be a fixed bed, a fluidized bed, an expanded bed, or an ebullating catalytic bed, known in the art.

The known separation techniques including filtration and operations using the centrifugal force, characterized by batchwise, semicontinous or other non-fully continuous regimes generally constitute production bottlenecks when applied to highly viscous liquids with suspensions of finely divided solid particles, especially where such products have to be handled in large flow rates under elevated pressures and relatively high temperatures, as is usually the case in separating mixed products of conversion of carbonaceous solids into more valuable materials. Such severe operating conditions result in lower outputs and in mechanical and equipment maintenance problems, giving rise to inefficient and costly technologies.

One object of the present invention is to improve the quality of the slurryform product of the conversion of carbonaceous solid materials in such manner that the liquid and solid constituents of that slurry be more readily separable.

Another object of this invention is to replace uneconomical operations of separating solids from a liquid carrier in carbonaceous slurryform effluents from liquefaction reactors by a more efficient and less costly operation, preferably of a fully continuous type.

Yet another object of the invention is to improve the yields and the overall value of the separated solid and liquid products of the coal liquefaction.

It is known that one major cause of difficulties in separating finely divided solids from liquid solutions produced in processes for converting coal or like carbonaceous materials into useful hydrocarbons lies in the mentioned above high viscosity of the products; and it has been found that this high viscosity is substantially imparted to the latter by the presence therein of phenolic and other acidic organic material bound with arylamines and other base type organic compounds into complex interlinked chemical structures of a high molecular weight.

Therefore, an early decomposition of such acid-base high molecular weight materials in effluents from reactors for liquefying carbonaceous materials would be advantageous for decreasing the viscosity of these effluents, and subsequently for easing the extraction of solid particles from the liquid effluent. That decomposition would be recommended also because its products once separated would be more valuable in their entity than before the decomposition and separation.

A main feature of this invention, the purpose of which is to attain the above objects, consists in reacting the slurryform part of the effluents, after their separation from gasifrom effluents originating in a carbonaceous solids liquefaction zone, with at least one of the following chemicals: alkali metal hydroxide (like caustic soda or potassium hydroxide), alkaline earth metal hydroxide (for example: slaked lime), ammonium hydroxide, alkali metal carbonates (such as sodium or potassium carbonate), or a similar alkali, preferably in presence of $H_2O$ in liquid and/or vapor form (water and/or steam respectively). Such alkaline chemical(s) is (are) mixed thoroughly with said slurryform in order to disintegrate, to "wet" and to obtain separate mineral particles and separate organic or semiorganic fractions, while decomposing the decomposable materials, then separating at least a part of the reaction products before subjecting at least a part of these products to further processing.

The mixing of the alkali with the slurry is preferably performed without using agitators or otherwise rotating or moving mechanical parts in the mixing equipment to avoid excessive maintenance and mechanical problems which usually arise when such moving parts have to work properly and continuously under severe operating conditions including elevated pressures and temperatures and the presence of abrasive and of volatile flammable materials in the enclosure where the mixing is efected and which as to be kept strictly tight.

The accompanying drawing shows an example of the embodient of the invention which will be further described with respect to the same. It is to be understood, of course, that the scope of the invention is not to be limited thereby.

As shown by the drawing, coal at line 11 together with coal liquefaction solvent at line 12 are fed to a coal feed preparation zone 13 where the coal with the solvent are mixed together, and the resulting coal feed is transferred through line 14 into a coal liquefaction zone 15 fed with hydrogen at line 16, said zone usually comprising a feed preheater (not shown in the drawing) for preheating the coal feed with the hydrogen feed or for preheating either of these feeds, in which zone the coal is subjected under elevated pressure and temperature, as is known in the art, to coal liquefaction reactions giving rise to a formation of gasiform and slurryform products which then are passed through line 17 into a gas separation zone 18 wherein the gasiform product is taken-off through line 19, and the slurryform product passed through line 20 into an alkali admixing and slurry treating zone 22 fed with an alkaline solution containing sodium hydroxide at line 21, that zone including an inline static mixer 23 (known in the art as having no moving mechanical parts) wherein the slurryform undergoes a thorough mixing with the alkali by means of static internals (shown in the drawing as symbols only), before passing through line 24 into a by-gravity-settling and separating zone 25 which usually contains more than one by-gravity-settling separation unit, and it preferably comprises, as illustrated, at least three units 26, 28, and 32, and preferably at least one of them, generally the first of the series, being composed of a multiplate type settling separator known in the art.

In the first by-gravity separation unit 26 which is of said multiplate type and contains a plurality of (schematically shown) substantially sloped plates **26*a* with settling spacings 26*b*, the treated slurry introduced at line 24** undergoes a separation by forming two main stream layers: most solids with a residual liquid solution form an underflow stream, while a hydrocarbon liquid rich fraction with froth containing some impurities mainly composed of entrained solid fines and droplets of liquid insoluble in said hydrocarbon liquid forms an overflow layer in the gravity settling unit.

The underflow in line 27 is introduced into a next by-gravity-settling unit 28 (which may be of a multiplate type, like the unit 26) wherein the solids with the residual solution separate into a solids deposit layer being taken-off at line 29, and an upper stream of the residual solution being withdrawn at line 30 for futher processing.

The overflow stream from the unit 26, comprising the hydrocarbon rich liquid and the froth in line 31, feeds a by-gravity separation unit constituted by a vessel 32 provided with an injector of a foam destroying agent 34, that agent being usually a pressurized vapor or gas which after the injection onto the frothy surface of the overflow layer in the vessel is removed from the latter by the vent 33. The entrained solid fines and other impurities insoluble in the hydrocarbon rich liquid and of a higher density than the latter are removed as residue from the vessel through line 36, while lighter impurities which may be in form of a residual froth are taken-off through line 37. The hydrocarbon rich liquid, essentially solids free, is transferred from the vessel through line 35 into a fractionation zone 38 wherein it is subjected to distillation operations known in the art for producing valuable hydrocarbon fractions one of which has the characteristics of the coal liquefaction solvent. That coal liquefaction solvent withdrawn from the fractionation zone through line 39 can supply, through line 12 at least a part of the coal liquefaction solvent needs in the coal preparation zone 13. All other hydrocarbon products from the fractionation zone 38, excepting the residues which are removed from said zone at line 41, are represented by the products withdrawal line 40.

Since many possible embodiments may be made of the invention without departing from the scope thereof, it is to be understood that all matter herein set forth or shown in the accompanying drawing is to be interpreted as illustrative and not in a limiting sense.

What I claim is:

1. A process for separating slurryform products of coal liquefaction into coal derived solids and coal derived liquids produced from a coal feed and separated from gasiform products of said liquefaction comprising:

treating at least a part of said slurryform with an alkali selected from the group consisting of alkali metal hydroxides, alkaline earth metal hydroxides, ammonium hydroxide, and alkali metal carbonates, in presence of hydrogen oxide, mixing in an inline static mixer the slurryform with said alkali in presence of hydrogen oxide, and subjecting the so produced material to gravity settling and forming, in a gravity settling separator, an underflow layer comprising a solids rich fraction and a liquid residue fraction, and an overflow layer comprising a hydrocarbon liquid rich fraction with a froth fraction including solid fines and residual impurities nonsoluble in said hydrocarbon liquid, and withdrawing at least a part of said fractions from said separator.

2. The process of claim 1 wherein the withdrawn part of said fractions comprises said underflow, further comprising separating the latter into a solids rich fraction and a liquid residue fraction in a solids-liquid separator.

3. The process of claim 1 wherein the withdrawn part of said fractions comprises said overflow, further comprising subjecting the latter to gravity settling and to forming a hydrocarbon liquid rich layer and a froth layer in a next gravity settling separator provided with froth-foam destroying means.

4. The process of claim 3 wherein said froth-foam destroying means is a pressurized vapor or gas injector.

5. The process of claim 1 wherein the withdrawn part of said fractions comprises said overflow, further comprising separating by gravity settling the hydrocarbon liquid comprised in said overflow from said residual impurities in a next gravity settling separator.

6. The process of claim 5, further comprising subjecting the separated said hydrocarbon liquid to a fractionating distillation yielding a coal liquefaction solvent fraction and admixing at least a part of said coal liquefaction solvent to said coal feed in the coal liquefaction process.

7. The process of claim 2 wherein said solids-liquid separator is a multiplate gravity settler containing a plurality of substantially inclined and spaced plates forming a multiplicity of gravity settling spacings.

8. The process of claim 1 wherein said slurryform treating alkali comprises sodium hydroxide.

9. The process of claim 1 wherein said slurryform treating alkali comprises ammonium hydroxide.

10. The process of claim 1 wherein said slurryform treating alkali comprises calcium hydroxide.

11. The process of claim 1 wherein said slurryform treating alkali comprises sodium carbonate.

* * * * *